US005466279A

United States Patent [19]

Hattori et al.

[11] Patent Number: 5,466,279

[45] Date of Patent: Nov. 14, 1995

[54] ELECTRIC DUST COLLECTOR SYSTEM

[75] Inventors: Takao Hattori, Yotsukaido; Takaki Iwanaga; Toru Yamaguchi, both of Yokohama, all of Japan

[73] Assignee: Kabushiki Kaisha Toshiba, Kawasaki, Japan

[21] Appl. No.: 183,797

[22] Filed: Jan. 21, 1994

Related U.S. Application Data

[63] Continuation of Ser. No. 800,075, Nov. 29, 1991, abandoned.

[30] Foreign Application Priority Data

Nov. 30, 1990 [JP] Japan ..... 2-330333

[51] Int. Cl.[6] ..... B03C 3/45; B03C 3/60

[52] U.S. Cl. ..... 96/69; 29/25.01; 96/77; 96/98; 96/100; 427/126.4

[58] Field of Search ..... 96/69, 28, 77, 96/98–100; 29/25.01–25.03, 620, 885; 427/77, 126.4

[56] References Cited

U.S. PATENT DOCUMENTS

| | | | |
|---|---|---|---|
| 3,259,558 | 7/1966 | Hagiwara et al. | 427/126.4 X |
| 3,418,788 | 12/1968 | Sugimoto | 55/154 X |
| 4,166,729 | 9/1979 | Thompson et al. | 55/157 X |
| 4,216,000 | 8/1980 | Kofoid | 55/157 X |
| 4,354,861 | 10/1982 | Kalt | 55/155 X |
| 4,664,946 | 5/1987 | Enomoto et al. | 427/126.4 X |
| 4,710,203 | 12/1987 | Batza et al. | 55/154 X |
| 4,944,778 | 7/1990 | Yanagawa | 55/155 X |
| 5,143,524 | 9/1992 | Inculet et al. | 55/155 X |

FOREIGN PATENT DOCUMENTS

| | | | |
|---|---|---|---|
| 163097 | 5/1955 | Australia | 96/69 |
| 562774 | 9/1958 | Canada | 427/126.4 |
| 614410 | 2/1961 | Canada | 427/126.4 |
| 2317354 | 10/1974 | Germany | 96/69 |
| 48-88554 | 11/1973 | Japan | 55/154 |

*Primary Examiner*—Richard L. Chiesa
*Attorney, Agent, or Firm*—Foley & Lardner

[57] ABSTRACT

An electric dust collector system which contains a plurality of charging mechanisms such as ionizer electrodes for charging dust particles and a plurality of collector mechanisms such as collector electrodes for collecting the dust particles. The collector electrodes are oxidized inwardly from the surface to form a metal oxide semiconductor layer. An ionizer-collector integrated electric dust collector system where the collector electrodes are extended and connected from the ionizer electrodes is disclosed. In a preferred embodiment, an electric dust collector system further contains electrostatic filters for collecting the dust particles and mesh-shaped electrodes for applying the electric field.

20 Claims, 15 Drawing Sheets

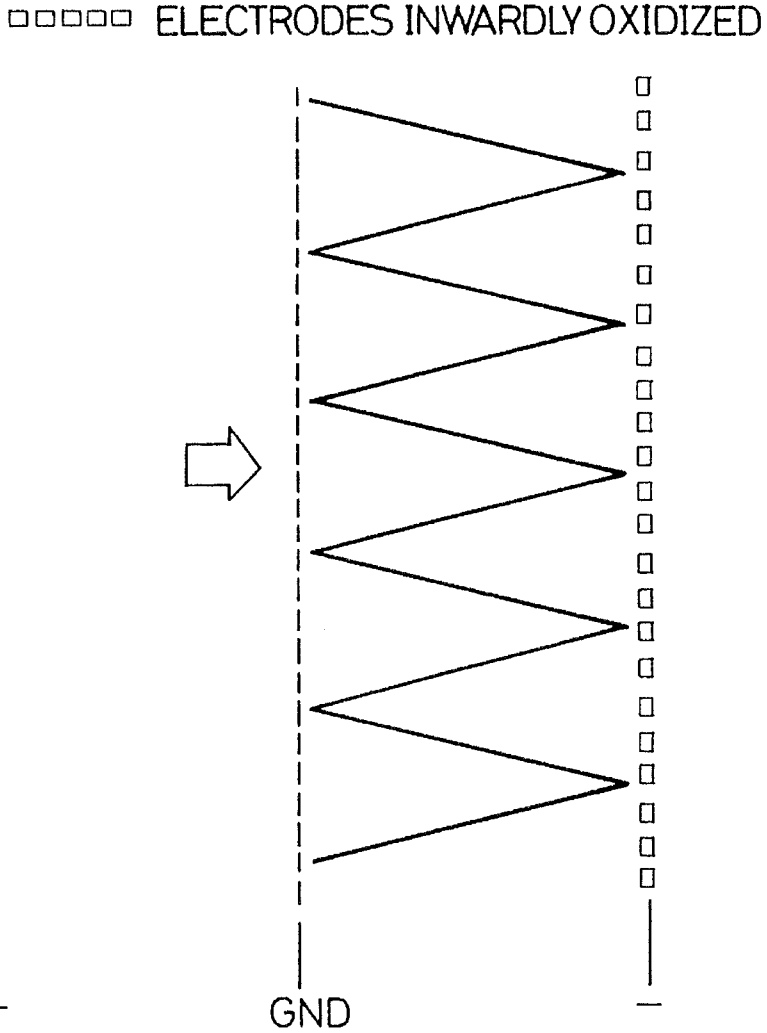
FIG. IIC
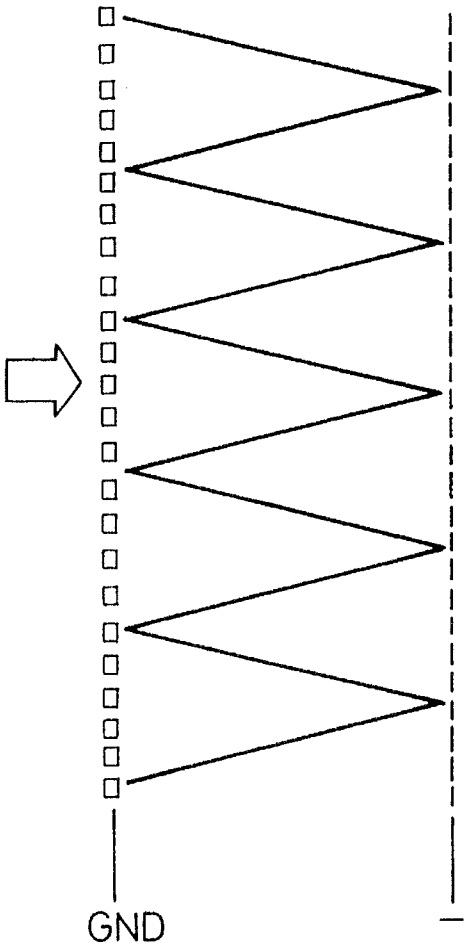
FIG. IIB
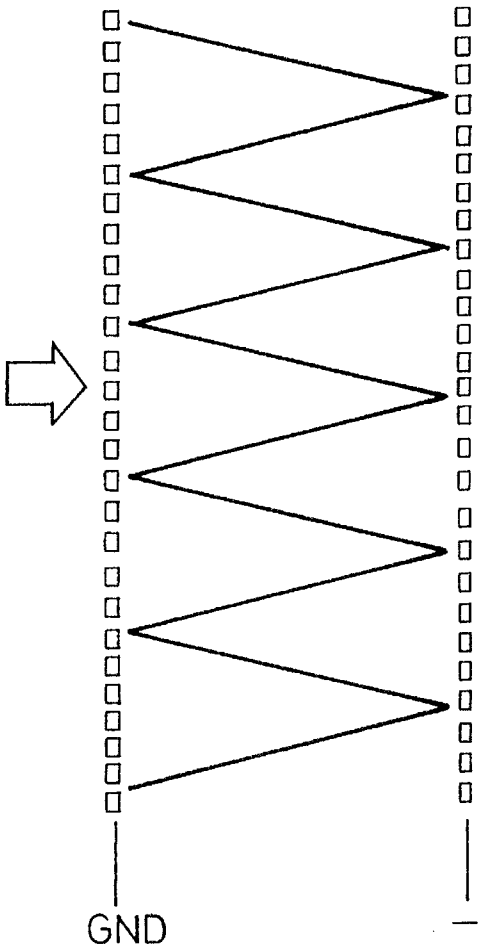
FIG. IIA

ELECTRIC DUST COLLECTOR SYSTEM

This application is a continuation of application Ser. No. 07/800,075, filed Nov. 29, 1991, now abandoned.

BACKGROUND OF THE INVENTION

1. Field of the Invention

The present invention relates to an electric dust collector system. More specifically, this invention relates to the improvement In electrode portions.

2. Description of the Prior Art

There are two major functions of an electric collecting system: One is to charge dust particles in the air by a corona discharging which takes place between a discharge electrode and a discharge counter electrode, and the other is to collect such discharged dust particles. A needle-shaped electrode, a fine metal string pulled by a spring, or the like is employed as the discharging electrode in the charging portion (also referred to as ionizer) to improve the discharging capability. The dust collector portion (also referred to as collector) comprises a dust collector electrode and a dust collector counter electrode each disposed counter to the discharging portion at suitable intervals. A stainless plate, stainless foil or insulated high polymer film with conductive coating material applied on its surface is employed as the dust collector electrode. A voltage smaller than that applied between the discharge electrode and the discharge counter electrode is applied to between the dust collector electrode and the dust collector counter electrode.

To restore the dust collecting efficiency after each use of the electric dust collector system, it is necessary to wash the both electrodes.

There is concern, however, that spark discharge will occur between the edges of the dust collector electrode and the dust collector counter electrode, when the metal is used for the dust collector electrode, unless the distance between both electrodes or the applied voltage is accurately controlled. When used is the high polymer film with conductive coating material applied on its whole surface, the spark discharge may also occur in the edge of the film. When the conductive coating material is applied to the central part of the high polymer film instead of to the edge of the film, the width of the high polymer film becomes greater, thus causing the depth of the dust collector portion to also become greater.

According to the Unexamined Japanese Patent Publication No. 48-88554, a semiconductor film having $10^5$–$10^{11}$ Ω·cm of resistivity on the surface is adhered to the substrate in order to avoid the spark discharge problem in the edge. However, in this case, there is concern that the adhered semiconductor film will be peeled off at the time of cleaning to restore the dust collecting power or will be peeled off by an abnormal discharge phenomenon.

SUMMARY OF THE INVENTION

The present invention was made in view of the above-mentioned problems, therefore, it is an object thereof to provide an electric dust collector system which can improve the durability in terms of electrode cleaning for maintenance, safety, reliability and compactness, by preventing the occurrence of abnormal discharge phenomena such as the spark discharge.

To achieve the object in the dust collector system where dust particles in the air are charged by corona discharge and then collected by the dust collector portion (also simply referred to as collector), the dust collector portion comprises a plurality of electrodes for applying electric effect wherein a metallic oxide semiconductive layer is formed inwardly from the surface of metal film. The metal oxide semiconductor layer is formed inwardly on the metal film surface, thus preventing the abnormal discharge phenomenon such as spark discharge. The metallic oxide semiconductive layer can be formed by oxidizing inwardly the metal surface whereby the durability of the system is improved for the metallic oxide semiconductor is not peeled off by cleaning the electrodes. Since the metallic oxide semiconductive layer is formed over the whole surface of metal film thereby leaving no edges uncovered, the depth size of the dust collector portion is reduced thus making the system further compact-sized.

BRIEF DESCRIPTION OF THE DRAWINGS

FIG. 9(*b*) shows an electric dust collector system shown in FIG. 9(*a*), where the electrodes at downstream side alone are inwardly oxidized from the surface.

FIG. 9(*c*) shows an electric dust collector system shown in FIG. 9(*a*), where the electrodes at upstream side alone are inwardly oxidized from the surface.

FIG. 10(*b*) shows an electric dust collector system shown in FIG. 9(*b*), where the negative electrodes are disposed in the downstream side.

FIG. 10(*c*) shows an electric dust collector system shown in FIG. 9(*c*), where the negative electrodes are disposed in the downstream side.

FIG. 11(*a*) shows an electric dust collector system, without having the ionizer, comprising the zigzag electrostatic filter and mesh-shaped electrodes between which the electrostatic filter is disposed according to the fifth embodiment of the present invention, where the earth electrodes are disposed in the upstream side, negative electrodes are in the downstream side, and the electrodes at both sides are inwardly oxidized from the surface.

FIG. 11(*b*) shows an electric dust collector system shown in FIG. 11(*a*), where the electrodes in the upstream side alone are inwardly oxidized from the surface.

FIG. 11(*c*) shows an electric dust collector system shown in FIG. 11(*a*), where the electrodes in the downstream side alone are inwardly oxidized from the surface.

FIG. 12(*b*) shows an electric dust collector system shown in FIG. 11(*b*), where the positive electrodes are disposed in the downstream side.

FIG. 12(*c*) shows an electric dust collector system shown in FIG. 11(*c*), where the positive electrodes are disposed in the downstream side.

FIG. 13(*b*) shows an electric dust collector system shown in FIG. 13(*a*), where the mesh-shaped electrodes in the upstream side alone are inwardly oxidized from the surface.

FIG. 13(*c*) shows an electric dust collector system shown in FIG. 13(*a*), where the plate electrodes in the downstream side alone are inwardly oxidized from the surface.

FIG. 14(*b*) shows an electric dust collector system shown in FIG. 13(*b*), where the negative electrodes are disposed in the downstream side.

FIG. 14(*c*) shows an electric dust collector system shown in FIG. 13(*c*), where the negative electrodes are disposed in the downstream side.

FIG. 15(*b*) shows an electric dust collector system shown in FIG. 15(*a*), where the mesh-shaped electrodes in the upstream side alone are inwardly oxidized from the surface.

FIG. 15(*c*) shows an electric dust collector system shown in FIG. 15(*a*), where the mesh-shaped electrodes in the downstream side alone are inwardly oxidized from the surface.

FIG. 16(*b*) shows an electric dust collector system shown in FIG. 15(*b*), where the negative electrodes are disposed in the downstream side.

FIG. 16(*c*) shows an electric dust collector system shown in FIG. 15(*c*), where the negative electrodes are disposed in the downstream side.

DETAILED DESCRIPTION OF THE PREFERRED EMBODIMENTS

Figure 1A:
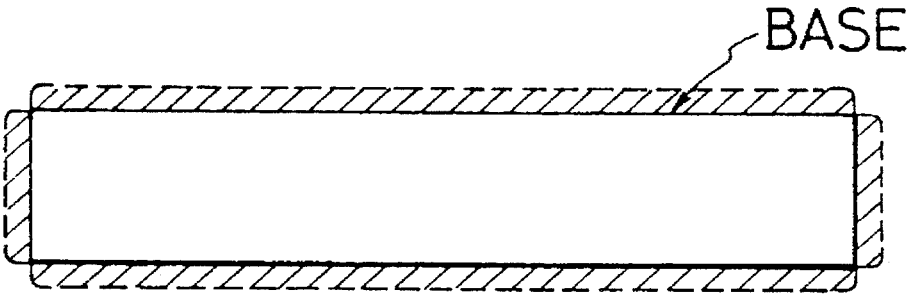
FIG. 1A PRIOR ART
FIG. 1A shows a collector electrode of which surface is coated with semiconductive layer according to the conventional invention.
Figure 1B:
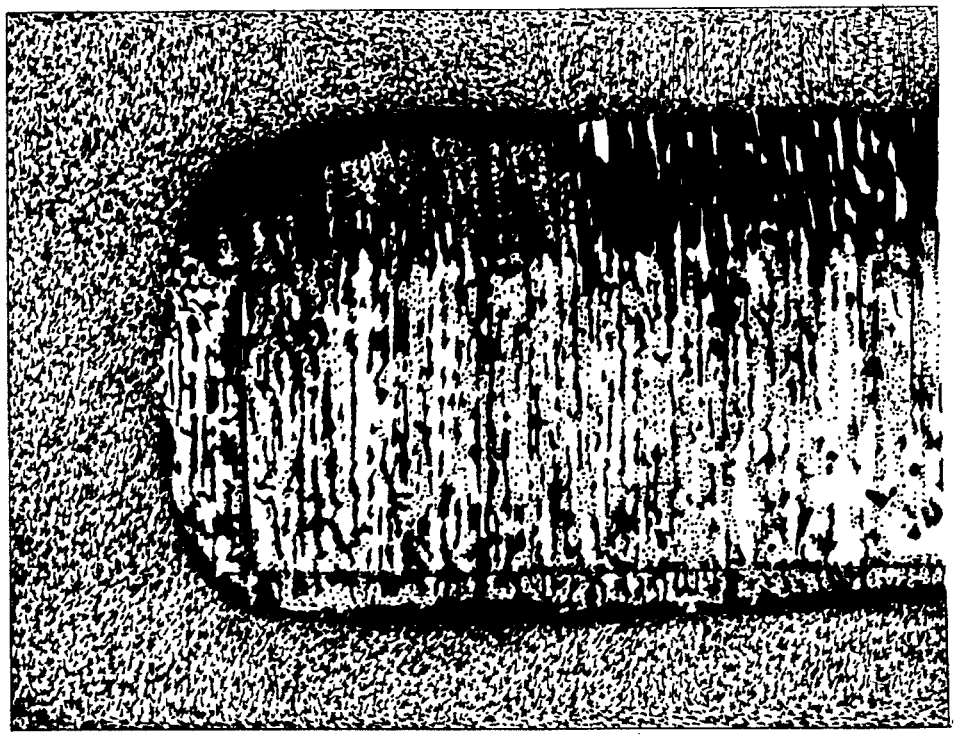
FIG. 1B PRIOR ART
FIG. 1B is a relevant drawing to FIG. 1A.
Figure 2B:
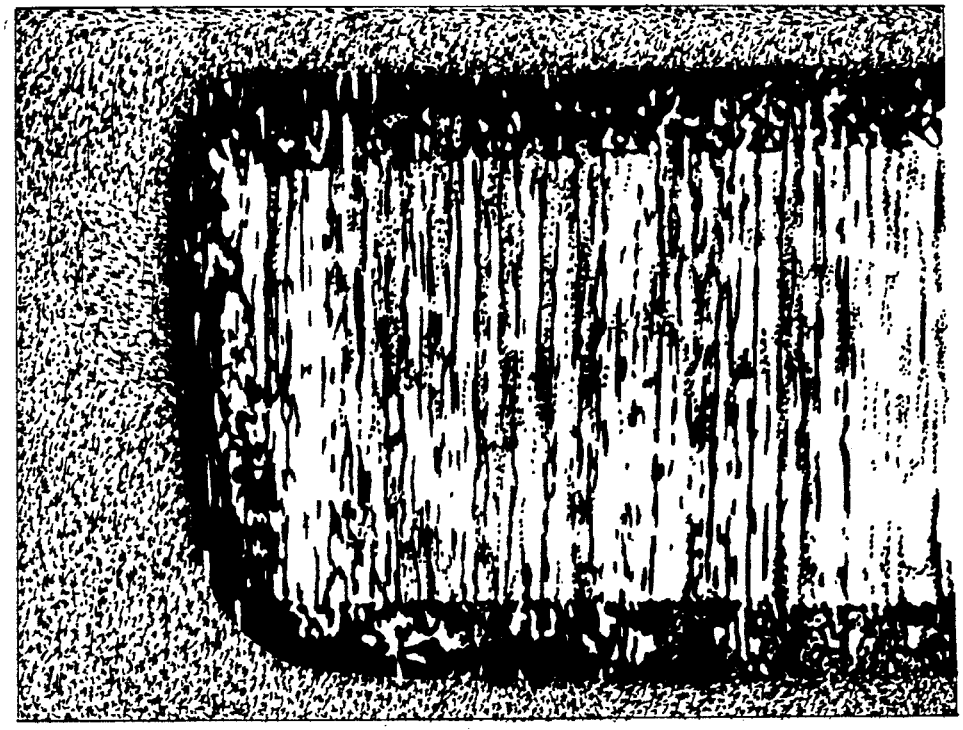
FIG. 2B is a relevant drawing to FIG. 2A.

FIG. 1A shows a collector electrode, in the conventional electric dust collector system, of which surface is coated with semiconductive layers. Such layers formed outwardly from the surface of the collector electrode are granulated discontinuous ones, thus causing a contact problem between a bare surface of the electrode and the layer. FIG. 1B shows a drawing of such collector electrode shown in FIG. 1A.

Figure 2A:
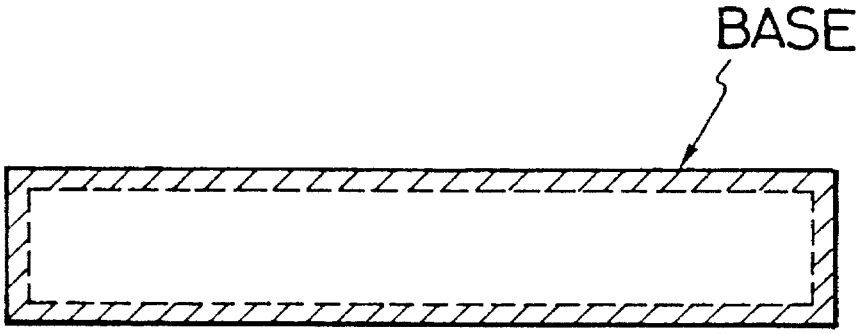
FIG. 2A shows a collector electrode of which surface is inwardly oxidized to form a metallic oxidation semiconductive layer according to the present invention.

FIG. 2A shows a collector electrode, in the present electric dust collector system, of which surface is oxidized inwardly to form a metallic oxide semiconductive layer. Such layer is a continuous semiconductive one in the atomic structural level, therefore it is a stable layer. Hence, it becomes possible to further increase the applied voltage and to further reduce the distance between the electrodes.

Figure 3:
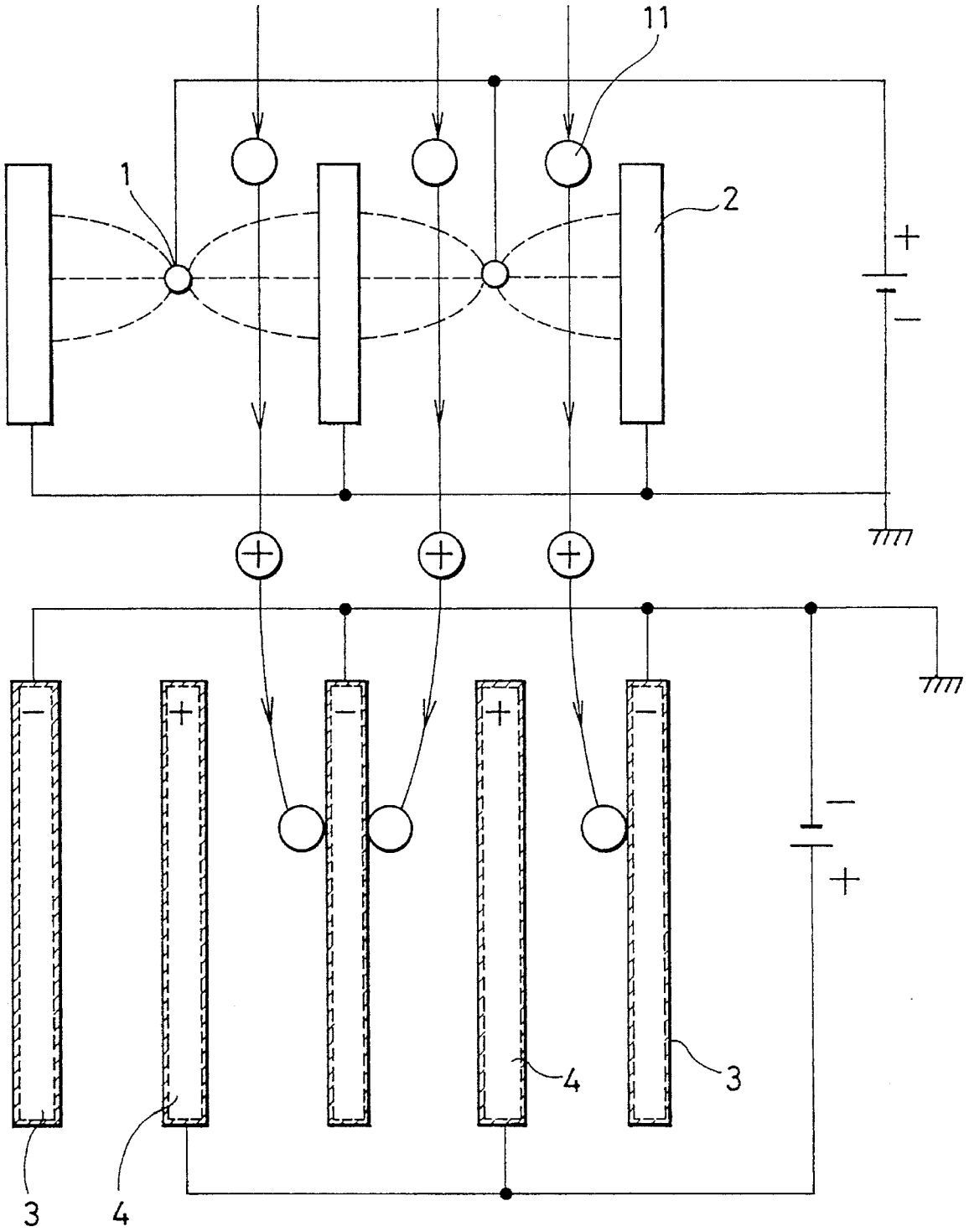
FIG. 3 shows a configuration of ionizer and collector electrodes according to the first embodiment of the present invention.

Referring to FIG. 3, a structure of the electric dust collector system according to the present invention is explained as follows.

A dust charging portion (also referred to as an ionizer) for charging dust particles is provided in the upstream area with the air flowing in the direction of arrows indicated in FIG. 3. The dust charging portion (the ionizer) comprises a plurality of discharge electrodes 1 and discharge counter electrodes 2. In the downstream area in FIG. 3, a dust collector portion (also simply referred to as a collector) for collecting dust particles is provided. The dust collector portion (the collector) comprises a plurality of collector electrodes 3 and collector counter electrodes 4.

Figure 4:
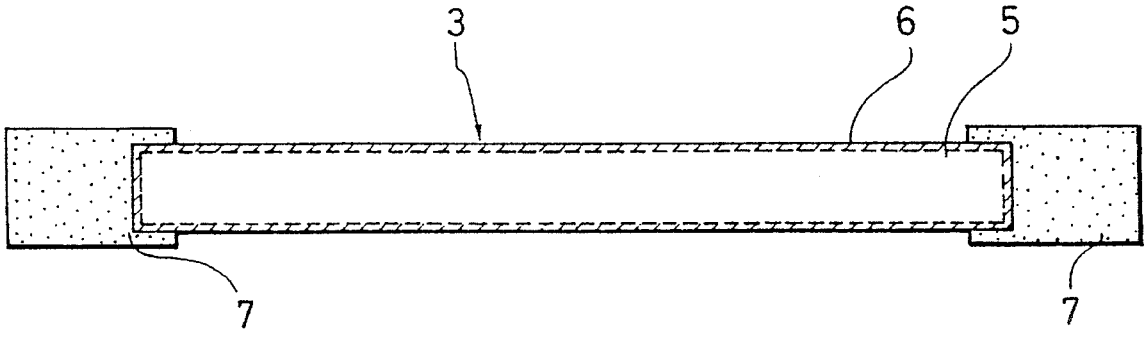
FIG. 4 shows an exploded cross-sectional view of the collector electrode shown in FIG. 3.

FIG. 4 shows a configuration of the collector electrode 3. A SUS foil 5, as a base electrode material, of about 100 μm thickness is heat-treated in the air of 600° C. for 30 minutes, then a metallic oxide semiconductive layer 6 of about 10 μm is formed inwardly from the outermost surface. The thickness of the metallic oxide semiconductive layer 6 is preferably in the range of 2 through 50 μm. When the layer thickness is smaller than 2 μm, a tunnel current effect will occur to possibly cause the spark discharge in the edge of collector electrodes. When the layer thickness is greater than 50 μm, the layer will become a dielectric to deteriorate the dust collecting capability.

Figure 5:
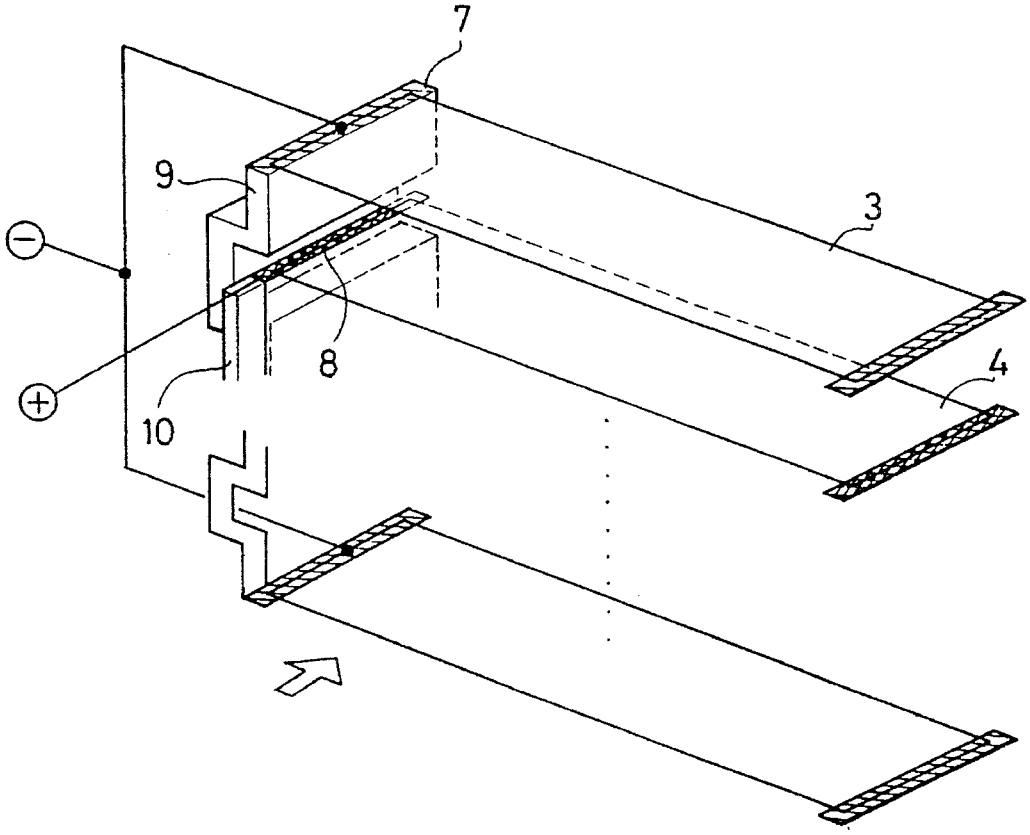
FIG. 5 shows a perspective view of how to support the collector electrodes shown in FIG. 4.

FIG. 5 shows a configuration of the collector electrode 3 and collector counter electrode 4 produced in the aforementioned manner. The both ends of the collector electrode 3 and collector counter electrode 4 are each held and connected between collecting electrodes 7, 8. The collecting electrodes 7, 8 are each connected to supporting members 9, 10. The collector electrode 3 is disposed counter to the collector counter electrode 4 with a suitable distance.

In the above-described embodiment, a high voltage is applied between the discharge electrode 1 serving as a positive electrode and the discharge counter electrode 2 as a negative electrode in the discharge portion in the upstream area, to generate a corona discharge by which dust particles 11 in the air is charged. In the collector portion in the downstream area, a voltage smaller than that applied between the discharge electrodes 1, 2 is applied between the collector electrode 3 as a negative electrode and the collector counter electrode 4 as a positive electrode, to collect the charged dust particles 11.

The following comparison tables present the centreliability over the abnormal discharge and the deterioration in dust collecting efficiency comparing with a conventional example.

Used in such a comparison example is a dust collector system of which collector portion was configured in the same manner as the above-described embodiment, where the high polymer film (polypropylene) with conductive coating material including conductive carbon black was applied upon the whole surface of the dust collector electrode.

Table 1 shows the number of abnormal discharge occurrence for the first 10 minutes. When a normal voltage of 2.0 kV and an excess voltage of 4.0 kV were each applied, the abnormal discharge did not occur to the dust collector system of the present invention. The abnormal discharge occurred as many as 32 times to the conventional example. It will be appreciated that it is possible to further reduce the distance between the collector electrodes comparing to the conventional ones; furthermore, even if the distance of electrodes therebetween is kept the same, it is possible to apply a higher voltage to the electrodes in the present invention, thus improving dust collecting efficiency.

TABLE 1

| | Applied Voltage of 2.0 kV | Applied Voltage of 4.0 kV |
|---|---|---|
| Preferred Embodiment | 0 | 0 |
| Comparison Example (Conventional) | 0 | 32 |

Table 2 shows how many times of cleaning took for the smoke collecting efficiency to become less than 50% of the initial value when each collector electrode was repeatedly cleaned by a household neutral detergent. In the preferred embodiment, the deterioration progress was found much slower than the conventional comparison example, while in the conventional comparison example the peeling between the bare surface of electrode and the coating material occurred and became worse as the number of cleaning increased. By the time of twenty third cleaning, the dust collecting efficiency of the conventional comparison example became less than 50%.

TABLE 2

| | Number of times of cleaning carried out until dust collecting efficiency became less than 50% of initial value |
|---|---|
| Preferred Embodiment | 100 or more |
| Comparison Example (Conventional) | 23 |

The base electrode material in the dust collector portion is not limited to the SUS Foil as described in the above embodiment. It may be any metal which have a semiconductivity of $10^{-3}$ through $10^{10}$ Ω·m. The electrodes may be oxidized to form the metallic oxide semiconductive layer not only by the thermal treatment as used in the above embodiment but also by an oxygen-ion implantation, an excess thermal oxidation followed by ionitriding, an anodic oxidation, a chemical conversion treatments and so on. For example, the oxidation treatment may be carried out by the oxygen-ion implantation under the oxygen-ion energy of 10 keV–999 keV; by excess thermal oxidation of leaving in an oxidizing gas atmosphere at a temperature of more than 550° C., followed by ionitriding under a treatment temperature of 400° C. and a making discharge power supply of more than 100 kW; by anodic oxidation; by chemical conversion oxidation, etc.

Figure 6A:
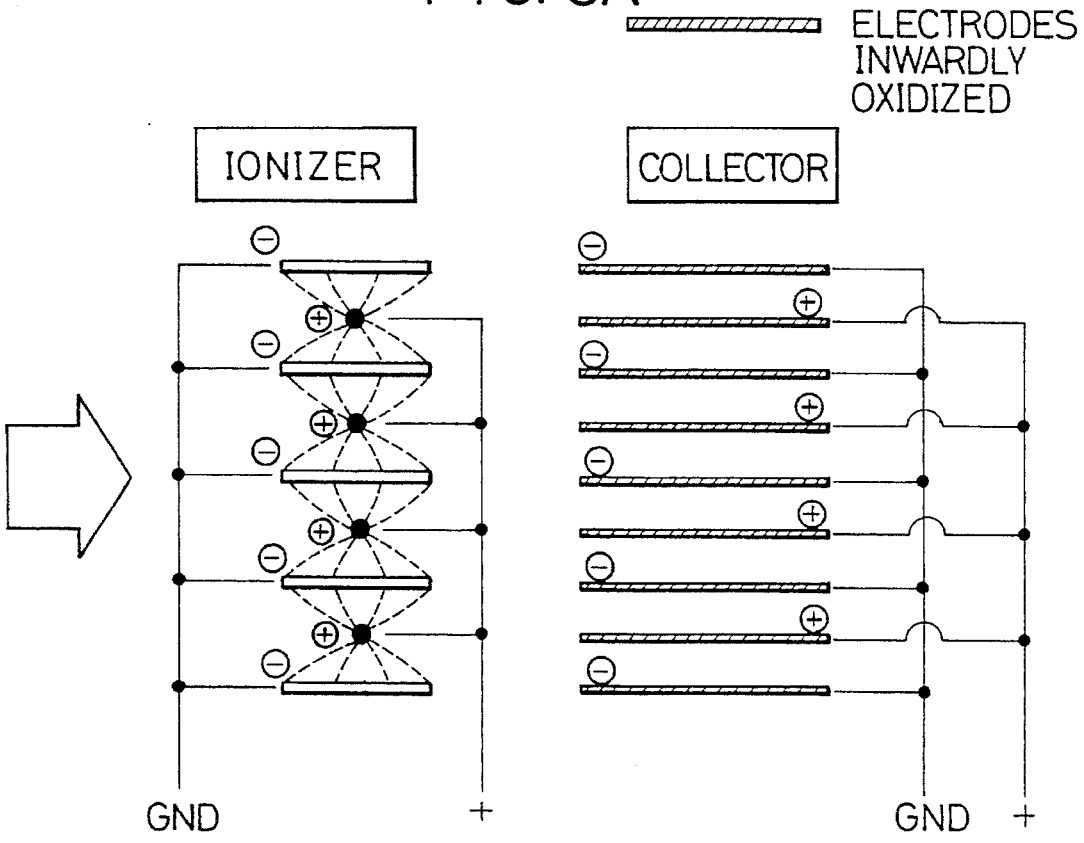
FIG. 6A shows a two-stage electric dust collector system comprising ionizing wires (discharge electrodes) of positive discharge and the collector according to the second embodiment of the present invention, where both positive and negative collector electrodes are inwardly oxidized from the surface.
Figure 6B:
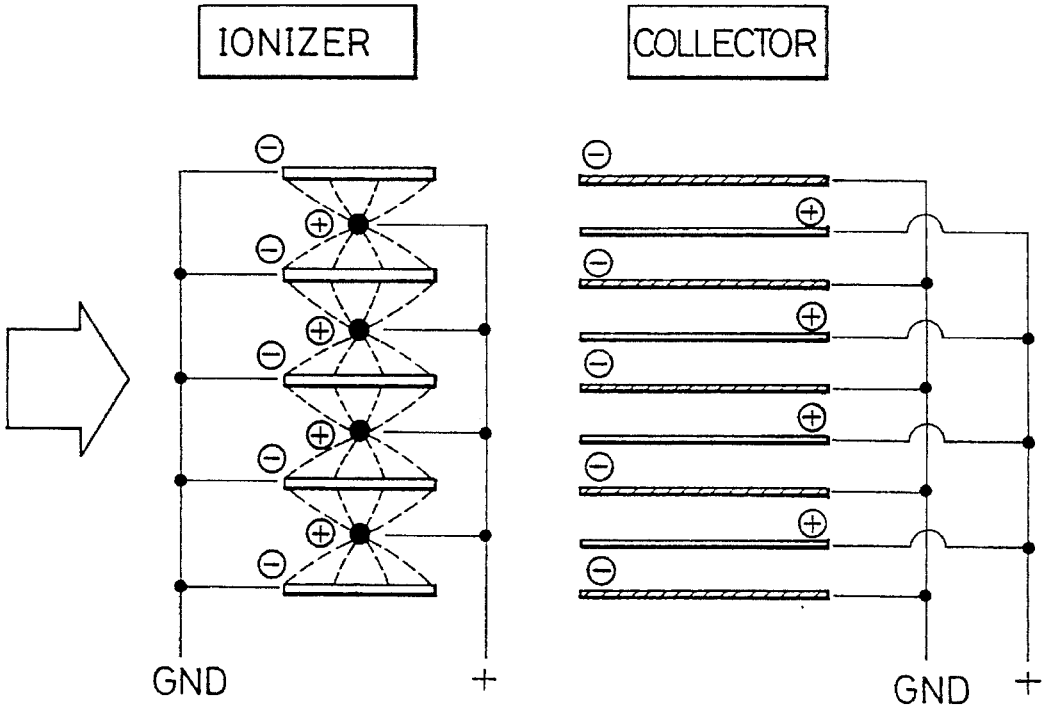
FIG. 6B shows a two-stage electric dust collector system shown in FIG. 6A, where the negative collector electrodes alone are inwardly oxidized from the surface.
Figure 7A:
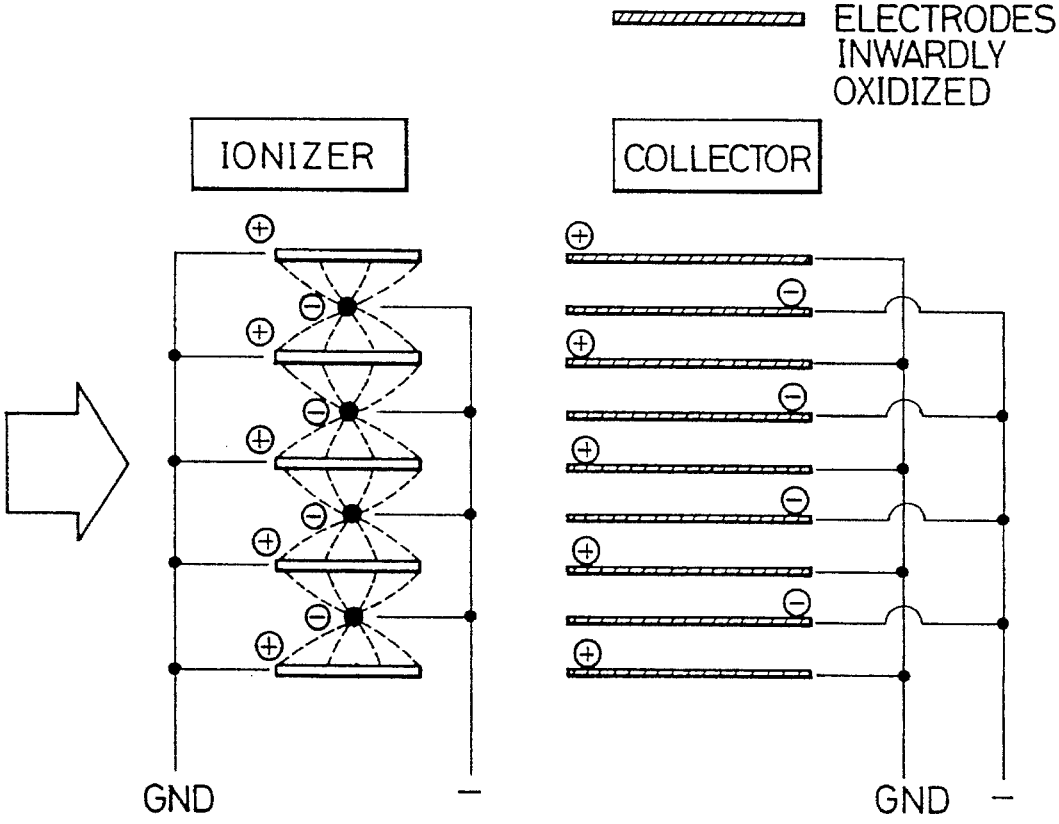
FIG. 7A shows a two-stage electric dust collector system shown in FIG. 6A, where the ionizing wires (discharge electrodes) are of negative discharge, and where both positive and negative collector electrodes are inwardly oxidized from the surface.
Figure 7B:
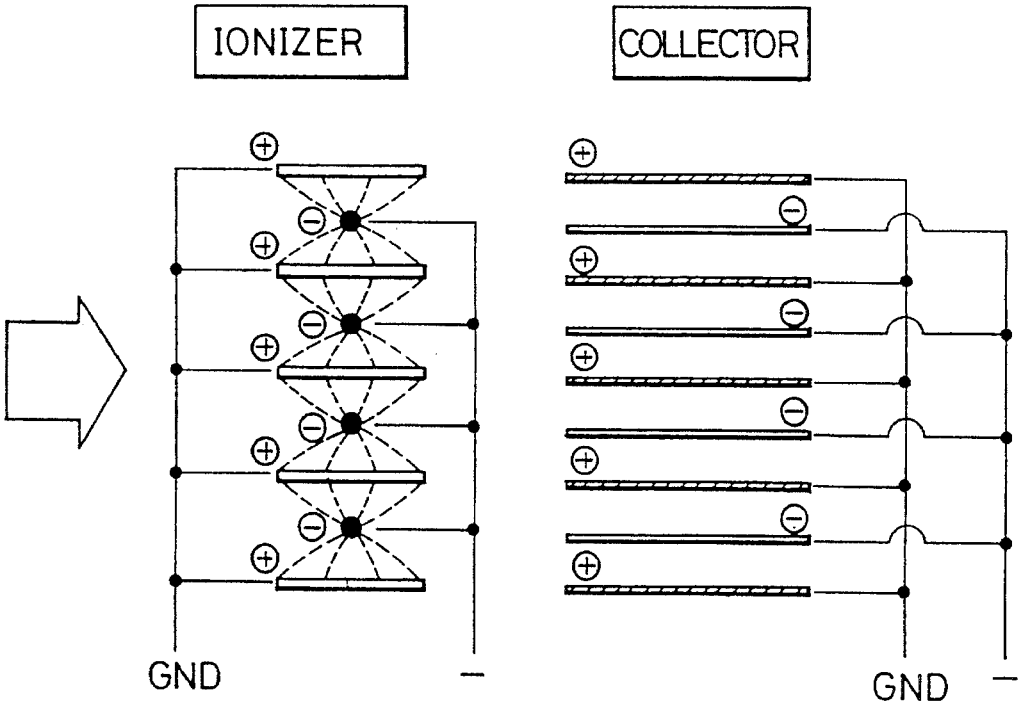
FIG. 7B shows a two-stage electric dust collector system shown in FIG. 7A, where the positive collector electrodes alone are inwardly oxidized from the surface.

It will be appreciated that various types of modification may be made according to the above-described present invention as follows:

In accordance with the second embodiment of the present invention shown in FIGS. 6 and 7, a two-stage electric dust collector system comprises ionizing wires (discharge electrodes) and the collector, where both positive and negative collector electrodes, or at least one of them, are inwardly oxidized from the surface to form a metallic oxide semiconductive layer. It will be noted that the second embodiment is substantially equivalent to the above-described first embodiment.

Figure 8A:
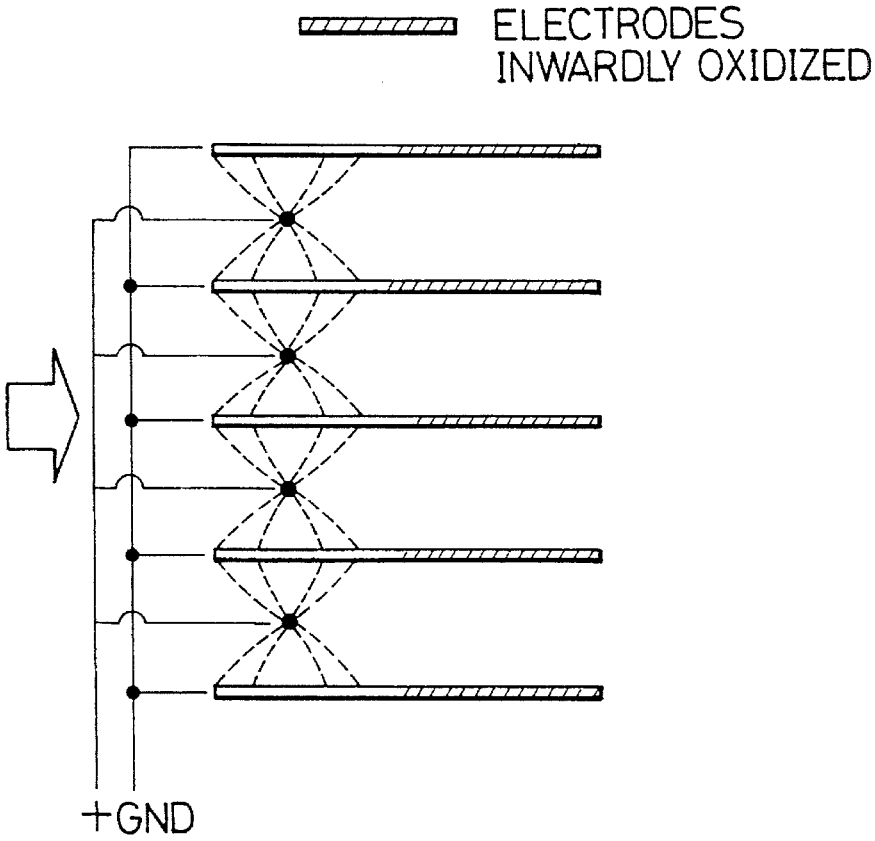
FIG. 8A shows an ionizer-collector integrated electric dust collector system according to the third embodiment of the present invention, where the ionizer is of positive discharge and the collector electrodes are inwardly oxidized from the surface.
Figure 8B:
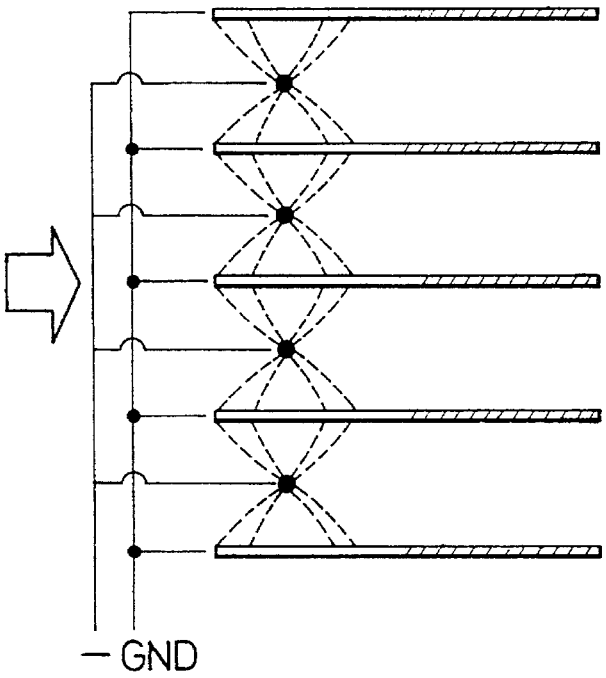
FIG. 8B shows an ionizer-collector integrated electric dust collector system shown In FIG. 8A, where the ionizer is of negative discharge.

In accordance with the third embodiment shown in FIG. 8, an ionizer and a collector are integrated by connecting the ionizer to the collector electrode so that the electrode serves as both ionizer as well as collector, where collector electrode are inwardly oxidized from the surface to form the metallic oxide semiconductive layer.

Another modified versions shown in FIGS. 9 through 16 are the electric dust collector systems in which there are no ionizers and the dust particles are collected by electrostatic filters.

Figures 9A, 9B, 9C:
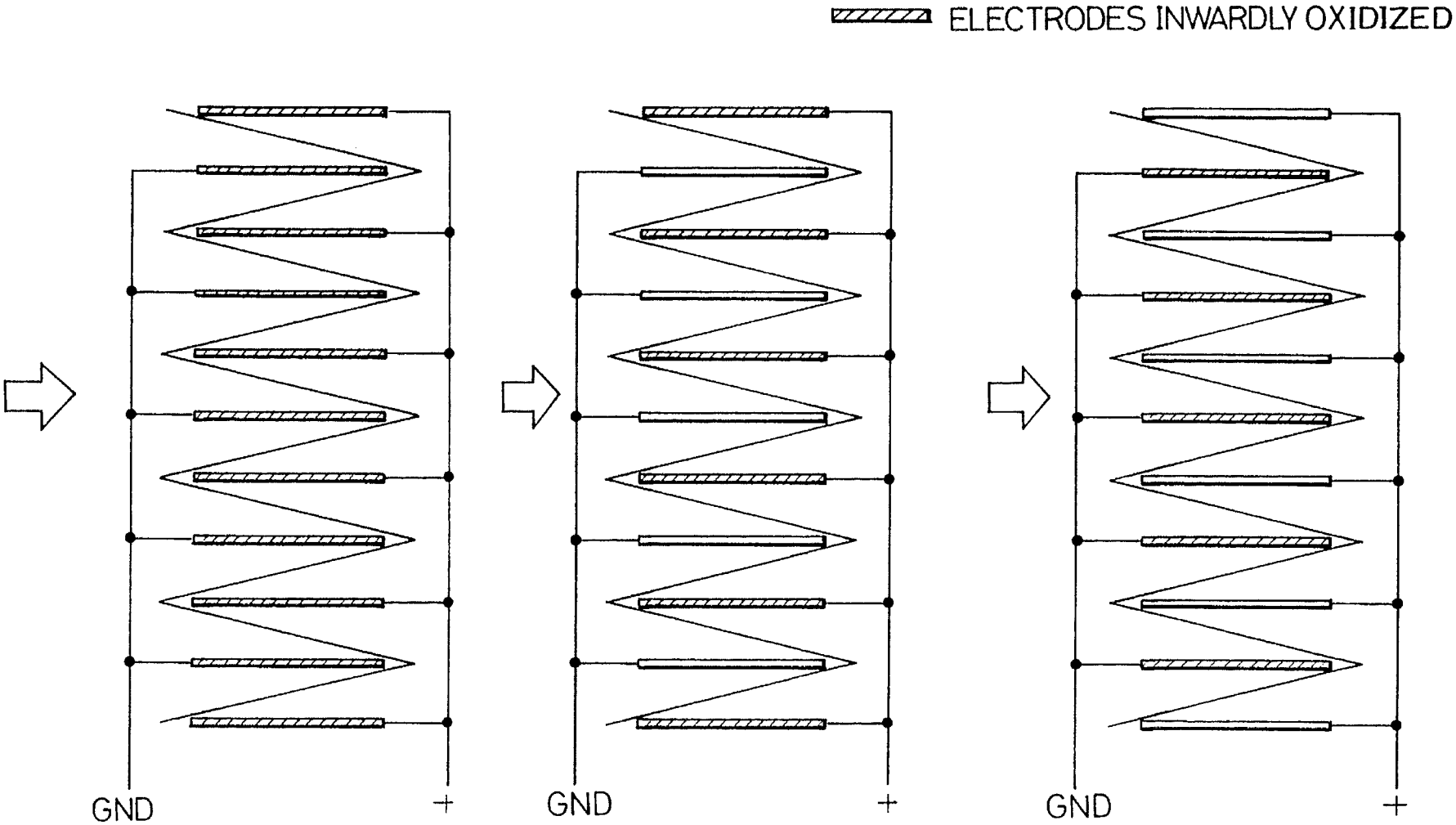
FIG. 9(*a*) shows an electric dust collector system, without having the ionizer, comprising a zigzag electrostatic filter and plate electrodes between which the electrostatic filter is disposed according to the fourth embodiment of the present invention, where earth electrodes arc disposed in the upstream side, positive electrodes are in the downstream side, and the electrodes at both upstream and downstream sides are inwardly oxidized from the surface.
Figures 10A, 10B, 10C:
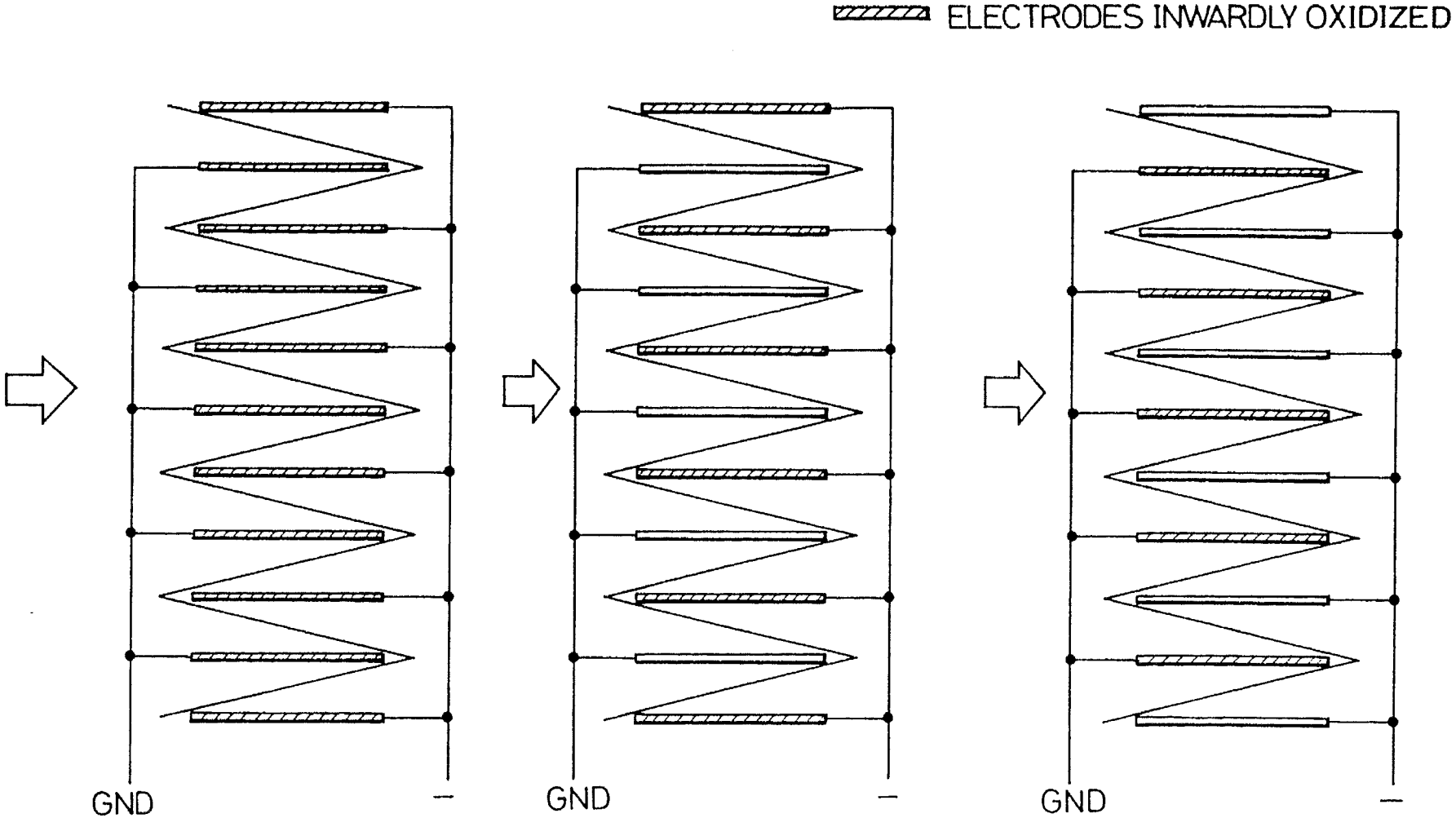
FIG. 10(*a*) shows an electric dust collector system shown in FIG. 9(*a*), where negative electrodes are disposed in the downstream side.

In accordance with the fourth embodiment shown in FIGS. 9 and 10, the electric dust collector system comprises a zigzag electric filter for collecting the dust particles and plate electrodes for applying the electric field whereby the durability and dust-collecting efficiency of the electrostatic filter are improved and maintained. The electrostatic filter is disposed adjacent to the plate electrodes. The earth electrodes are disposed in the upstream side with respect to the air flow direction (marked with an arrow) and the positive or negative electrodes are in the downstream side. The plate electrodes of at least one of the upstream side and the downstream side are inwardly oxidized from the surface to form the metallic oxide semiconductive layer.

Figures 12A, 12B, 12C:
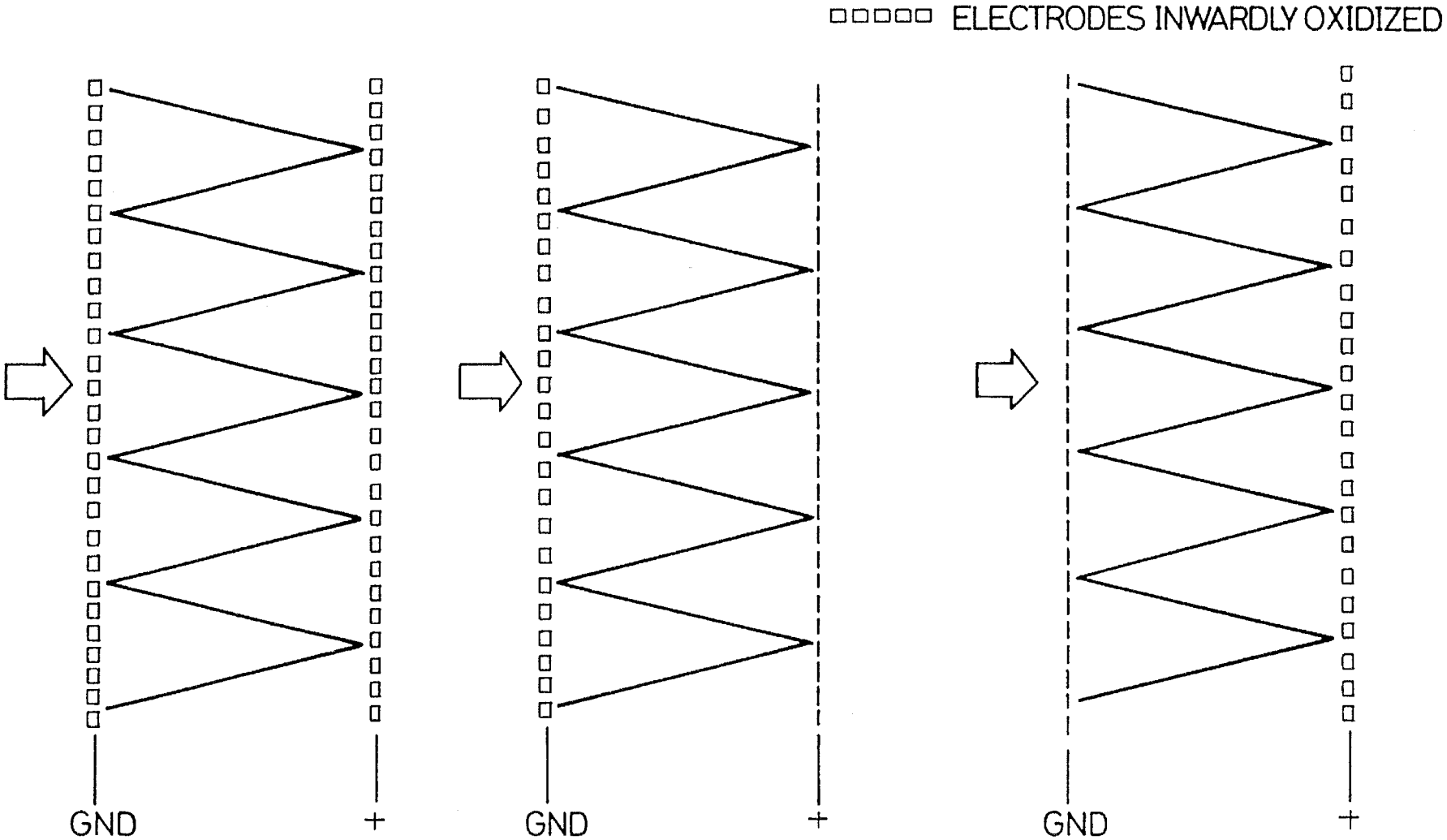
FIG. 12(*a*) shows an electric dust collector system shown in FIG. 11(*a*), where the positive electrodes are disposed in the downstream side.

In accordance with the fifth embodiment shown in FIGS. 11 and 12, the electric dust collector system comprises the zigzag electrostatic filter for collecting the dust particles, and mesh-shaped electrodes for applying the electric field. The electrostatic filter is disposed between the mesh-shaped electrodes. The earth electrodes are disposed in the upstream side and the positive or negative electrodes are in the downstream side. The mesh-shaped electrodes of at least one of the sides are inwardly oxidized from the surface to form the metallic oxide semiconductive layer.

Figure 13C:
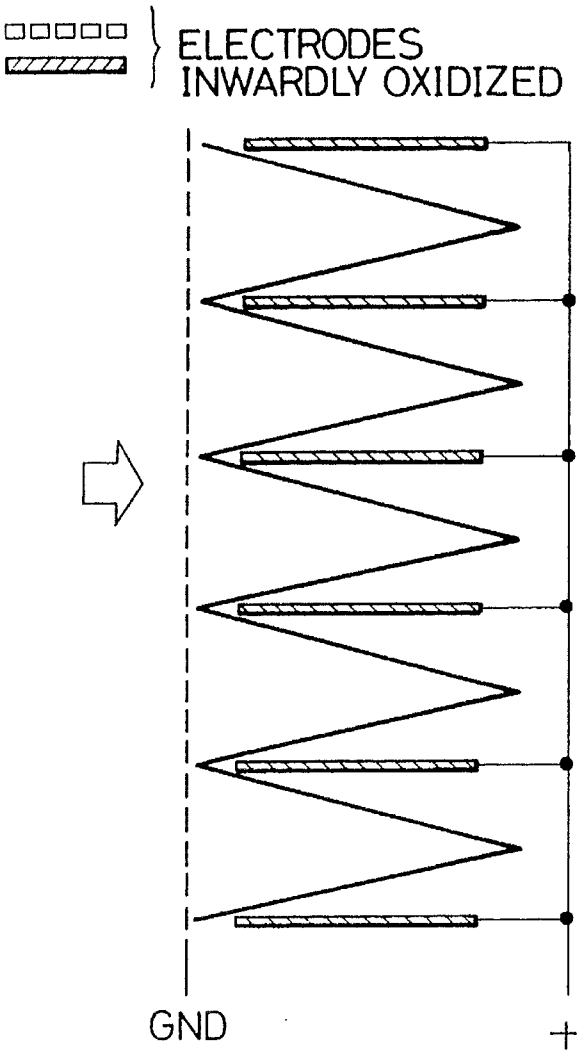
FIG. 13(*a*) shows an electric dust collector system, without ionizer, comprising the zigzag electrostatic filter, the mesh-shaped electrodes in the upstream side, and the plate electrodes between which the electrostatic film is disposed, according to the sixth embodiment of the present invention, where the earth electrodes are disposed in the upstream side, the positive electrodes are in the downstream side, and the electrodes at both sides are inwardly oxidized from the surface.
Figure 13B:
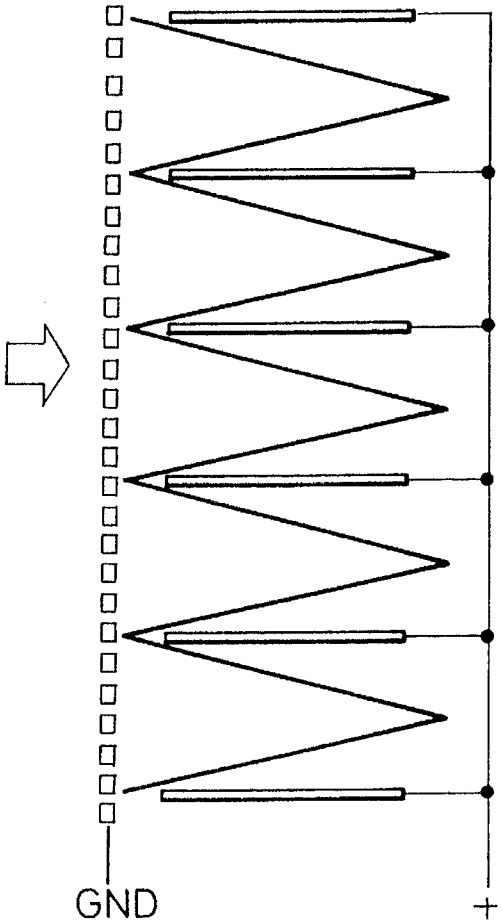
Figure 13A:
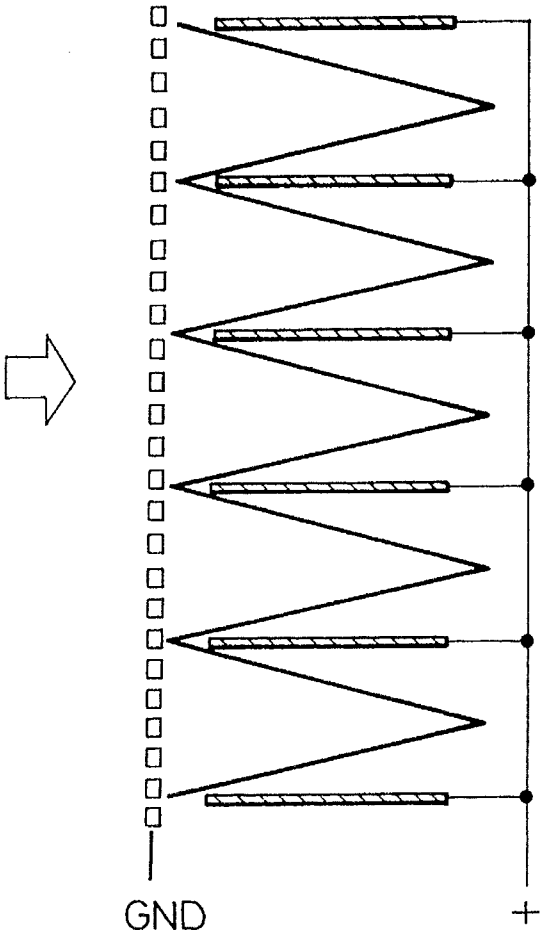
Figure 14C:
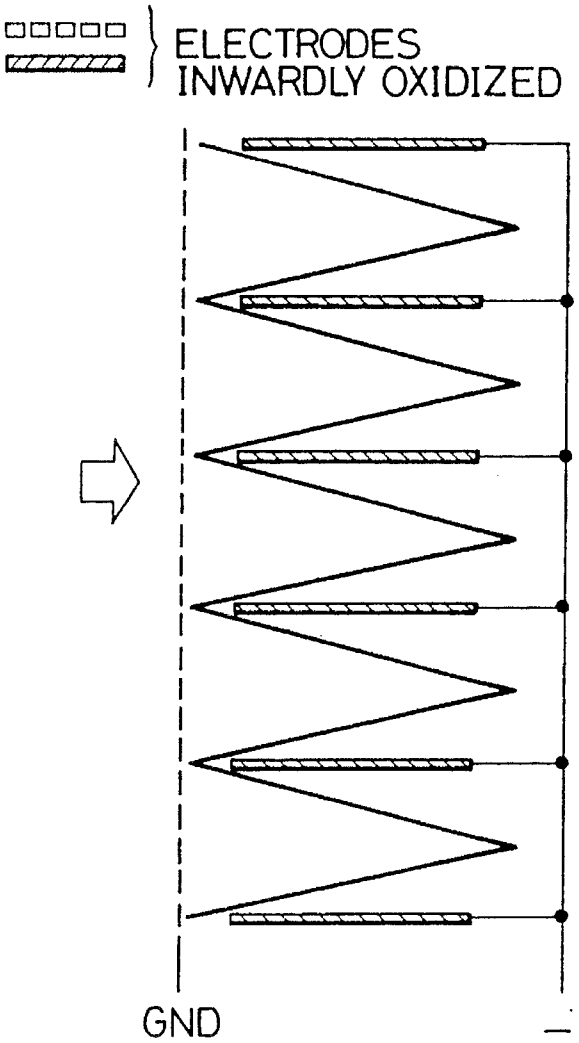
FIG. 14(*a*) shows an electric dust collector system shown in FIG. 13(*a*), where the negative electrodes are disposed in the downstream side.
Figure 14B:
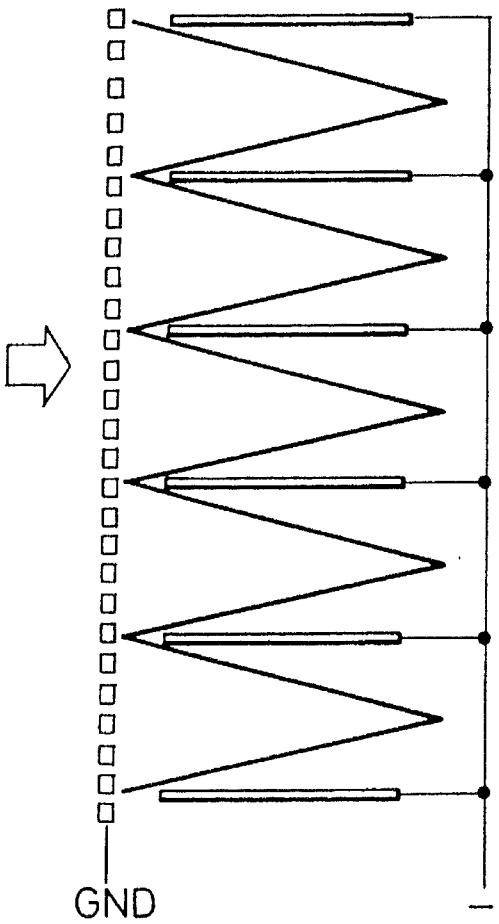
Figure 14A:
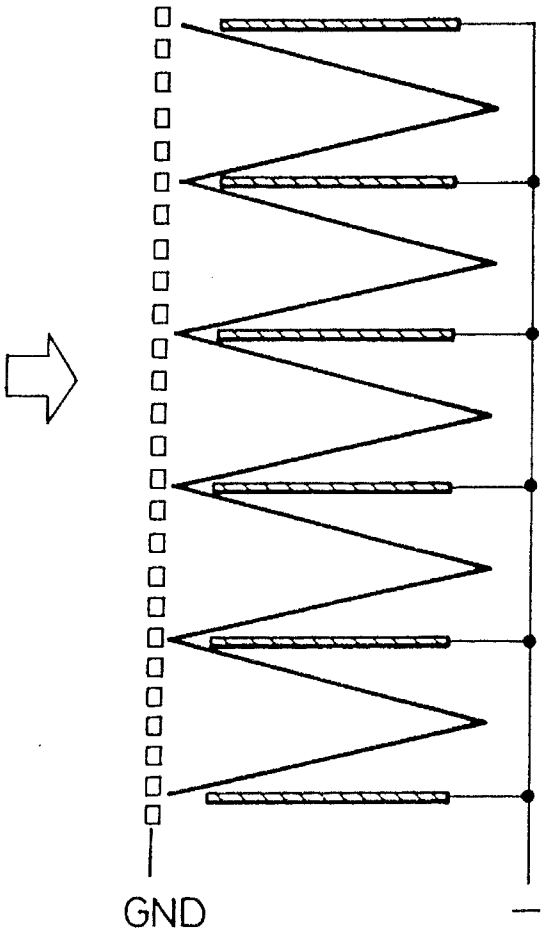

In accordance with the sixth embodiment shown in FIGS. 13 and 14, the electric dust collector system is configured based on the combination of the fourth and the fifth embodiments.

Figures 15A, 15B, 15C:
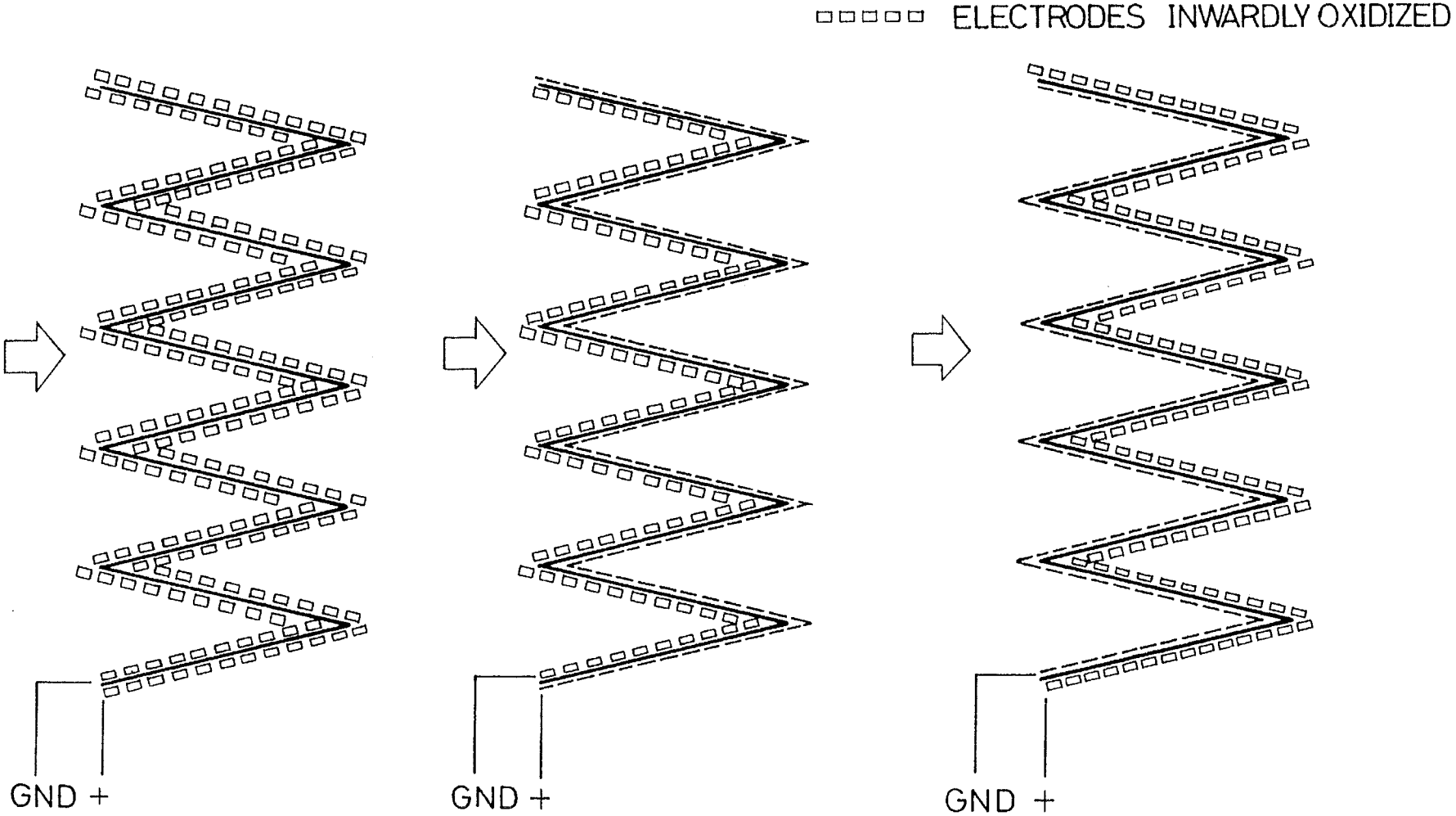
FIG. 15(*a*) shows an electric dust collector system, without having the ionizer portion, comprising the zigzag electrostatic filter and the mesh-shaped electrodes between which the electrostatic filters are sandwiched, according to the seventh embodiment of the present Invention, where the earth electrodes arc disposed in the upstream side, the positive electrodes are in the downstream side, and the electrodes at both sides are inwardly oxidized from the surface.
Figures 16A, 16B, 16C:
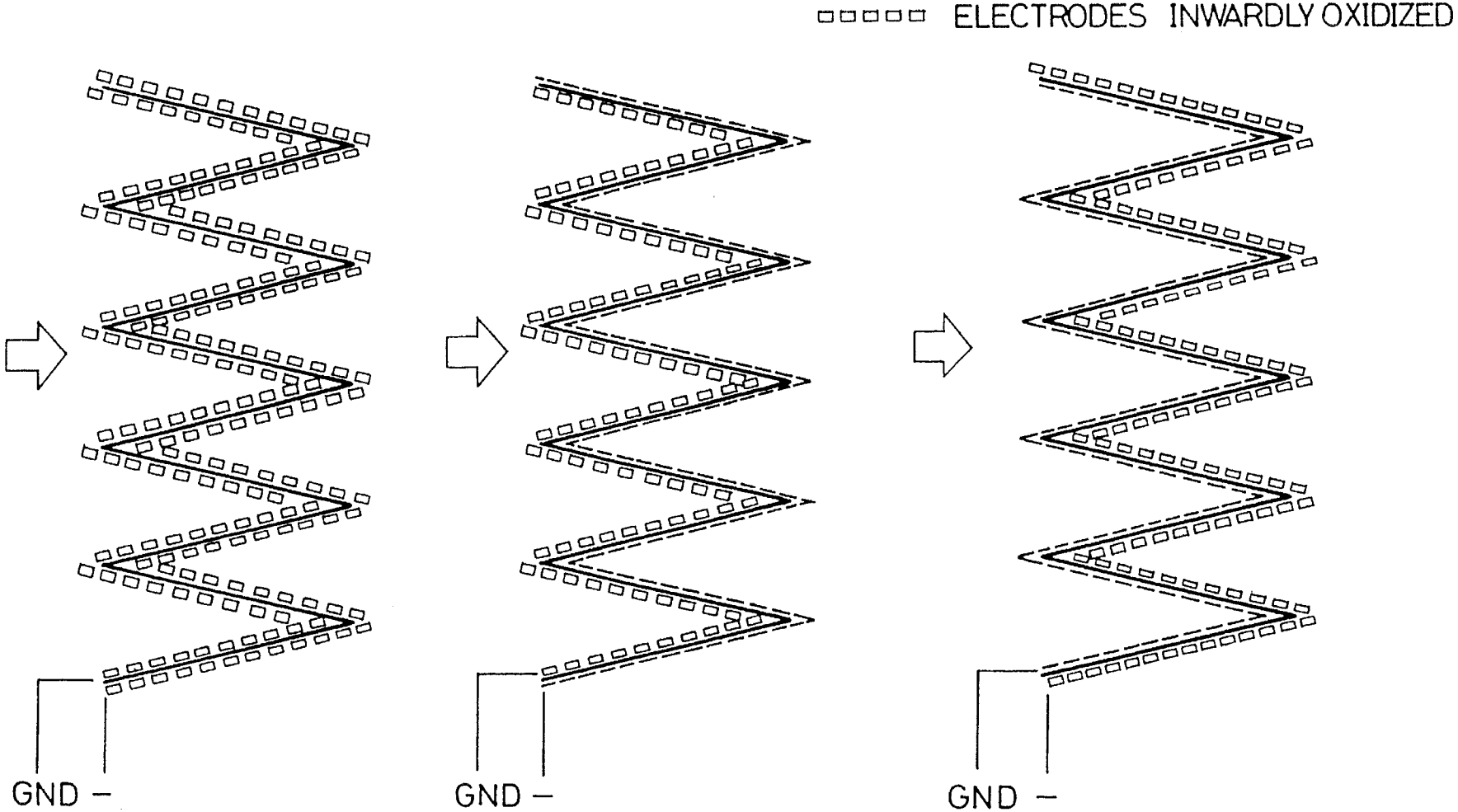
FIG. 16(*a*) shows an electric dust collector system shown in FIG. 15(*a*), where the negative electrodes are disposed in the downstream side.

In accordance with the seventh embodiment shown in FIGS. 15 and 16, the electric dust collector system comprises the electrostatic filter and the mesh-shaped electrodes between which the electrostatic filter is sandwiched. The earth electrodes are disposed in the upstream side and the positive or negative electrodes are in the downstream side. The mesh-shaped electrodes of at least one of the sides are inwardly oxidized from the surface to form the metallic oxide semiconductive layer.

In summary, since the metallic oxide semicondictive layer is formed inwardly on the metal film surface, the abnormal discharge phenomenon such as spark discharge can be prevented. The metallic oxide semiconductive layer can be formed by oxidizing inwardly the metal surface whereby the durability of the system is improved for the metallic oxide semiconductor is not peeled off at the time of cleaning the electrode. Furthermore, since the metallic oxide semiconductive layer is formed over the whole surface of metal film thereby leaving no edges uncovered, the depth size of the dust collector portion is reduced thus making the system further compact-sized.

What is claimed is:

1. An electric dust collector system for collecting dust particles in the air utilizing electric field, comprising:

charging means for charging the dust particles; and collector means for collecting the charged dust particles wherein a plurality of electrodes therefor include a metallic oxide semiconductive layer which is formed inwardly from the surface of the electrodes by an oxidation treatment, and wherein said metallic oxide semiconductive layer is formed inwardly within over the whole surface of said electrodes.

2. An electric dust collector system as claimed in claim 1, wherein said oxidation treatment is selected from the group consisting of a thermal treatment, an oxygen-ion implantation, an excess thermal oxidation followed by ionitriding, an anodic oxidation and a chemical conversion treatment.

3. An electric dust collector system as claimed in claim 1, wherein said charging means comprises ionizer means having a plurality of ionizer electrodes for charging the dust particles; and wherein said collector means has said plurality of collector electrodes for collecting the charged dust particles; the collector electrodes being disposed counter to the ionizer electrodes, the collector electrodes including said metallic oxide semiconductive layer being formed inwardly from the surface of the collector electrodes by said oxidation treatment.

4. The electric dust collector system according to claim 3, wherein the thickness of the metallic oxide semiconductive layer is in the range of 2–50 μm.

5. The electric dust collector system according to claim 3, wherein the collector electrodes are treated by at least one of the treatments selected from the group consisting of a thermal oxidation, an oxygen-ion implantation, an excess thermal oxidation followed by ionitriding, an anodic oxidation, and a chemical conversion oxidation.

6. The electric dust collector system according to claim 3, wherein at least one of the positive and negative electrodes of the collector electrodes are oxidized.

7. An electric dust collector system as claimed in claim 1, wherein said charging means comprises ionizer means having a plurality of ionizer electrodes for charging the dust particles; and wherein said collector means has a plurality of collector electrodes for collecting the charged dust particles; the collector electrodes being connected to the ionizer electrodes, the collector electrodes including a metallic oxide semiconductive layer being formed inwardly from the surface of the collector electrodes by an oxidation treatment.

8. The electric dust collector system according to claim 7, wherein the thickness of the metallic oxide semiconductive layer is in the range of 2–50 μm.

9. The electric dust collector system according to claim 7, wherein the collector electrodes are treated by at least one of the treatments selected from the group consisting of a thermal oxidation, an oxygen-ion implantation, an excess thermal oxidation followed by ionitriding, an anodic oxidation, and a chemical conversion oxidation.

10. The electric dust collector system according to claim 7, wherein at least one of positive and negative electrodes of the collector electrodes are oxidized.

11. An electric dust collector system as claimed in claim 1, wherein said collecting means comprises filter means having an electrostatic filter for collecting the dust particles; and wherein said electric dust collector further comprises an electric field means having a plurality of electrodes for applying the electric field; the electrodes being positioned in close proximity to the electrostatic filter, the electrodes including a metallic oxide semiconductive layer being formed inwardly from the surface of the electrodes by an oxidation treatment.

12. The electric dust collector system according to claim 11, wherein the thickness of the metallic oxide semiconductive layer is in the range of 2–50 μm.

13. The electric dust collector system according to claim 11, wherein the electrodes are treated by at least one of the treatments selected from the group consisting of a thermal oxidation, an oxygen-ion implantation, an excess thermal oxidation followed by ionitriding, an anodic oxidation, and a chemical conversion oxidation.

14. An electric dust collector system as claimed in claim 1, wherein said collecting means comprises filter means having an electrostatic filter for collecting the dust particles; and wherein said electric dust collector further comprises a plurality of plate electrodes for applying an electric field, between which the electrostatic filters are positioned, the plate electrodes including a metallic oxide semiconductive layer being formed inwardly from the surface of the plate electrodes by an oxidation treatment.

15. The electric dust collector system according to claim 14, wherein the thickness of the metallic oxide semiconductive layer is in the range of 2–50 μm.

16. The electric dust collector system according to claim 14, wherein the electrodes are treated by at least one of the treatments selected from the group consisting of a thermal oxidation, an oxygen-ion implantation, an excess thermal oxidation followed by ionitriding, an anodic oxidation, and a chemical conversion oxidation.

17. The electric dust collector system according to claim 14, wherein at least one of positive electrodes and negative electrodes of the plate electrodes are oxidized.

18. The electric dust collector system according to claim 14, further comprising a plurality of mesh-shaped electrodes for applying electric field, the mesh-shaped electrodes being positioned around the electrostatic filter and the plate electrodes, the mesh-shaped electrodes including the metallic oxide semiconductive layer being formed inwardly from the surface of the mesh-shaped electrodes by an oxidation treatment.

19. An electric dust collector system as claimed in claim 1, wherein said collecting means comprises filter means having an electrostatic filter for collecting the dust particles; and wherein said electric dust collector further comprises a plurality of mesh-shaped electrodes for applying an electric field, between which the electrostatic filters are positioned, the mesh-shaped electrodes including a metallic oxide semiconductive layer being formed inwardly from the surface of the mesh-shaped electrodes by an oxidation treatment.

20. The electric dust collector system according to claim 19, wherein the electrostatic filter is positioned between the mesh-shaped electrodes positioned parallel to the electrostatic filter.

* * * * *